US009728855B2

(12) United States Patent
Wang et al.

(10) Patent No.: US 9,728,855 B2
(45) Date of Patent: Aug. 8, 2017

(54) BROADBAND GNSS REFERENCE ANTENNA

(71) Applicant: Honeywell International Inc., Morristown, NJ (US)

(72) Inventors: Nan Wang, Shang Hai (CN); Orville Nyhus, Glendale, AZ (US)

(73) Assignee: Honeywell International Inc., Morris Plains, NJ (US)

( * ) Notice: Subject to any disclaimer, the term of this patent is extended or adjusted under 35 U.S.C. 154(b) by 482 days.

(21) Appl. No.: 14/154,886

(22) Filed: Jan. 14, 2014

(65) Prior Publication Data

US 2015/0200459 A1 Jul. 16, 2015

(51) Int. Cl.

| | |
|---|---|
| ***H01Q 21/12*** | (2006.01) |
| ***H01Q 21/20*** | (2006.01) |
| ***H01Q 9/04*** | (2006.01) |
| ***H01Q 1/12*** | (2006.01) |
| ***H01Q 1/24*** | (2006.01) |
| ***H01Q 9/28*** | (2006.01) |
| ***H01Q 21/08*** | (2006.01) |

(52) U.S. Cl.

CPC ..... *H01Q 9/0407* (2013.01); *H01Q 1/1242* (2013.01); *H01Q 1/241* (2013.01); *H01Q 1/246* (2013.01); *H01Q 9/28* (2013.01); *H01Q 21/08* (2013.01); *H01Q 21/205* (2013.01)

(58) Field of Classification Search

CPC ..... H01Q 1/1242; H01Q 1/241; H01Q 1/246; H01Q 9/28; H01Q 9/0407; H01Q 21/08; H01Q 21/205; H01Q 1/242; H01Q 21/20; H01Q 21/12

USPC ..... 343/799, 800, 778, 853, 890, 891

See application file for complete search history.

(56) References Cited

U.S. PATENT DOCUMENTS 2,227,563 A 1/1941 Werbdl
2,757,369 A * 7/1956 Darling ..... H01Q 21/26 343/800
2,939,143 A * 5/1960 Zisler ..... H01Q 9/28 343/773

(Continued)

FOREIGN PATENT DOCUMENTS

CN 101110499 1/2008
CN 102195143 9/2011

(Continued)

OTHER PUBLICATIONS

U.S. Patent and Trademark Office, "Office Action", from U.S. Appl. No. 13/879,300, Dec. 21, 2015, pp. 1-28, Published in: US.

(Continued)

*Primary Examiner* — Hoang Nguyen
(74) *Attorney, Agent, or Firm* — Fogg & Powers LLC

(57) ABSTRACT

A linear antenna array comprises a hollow support mast having a longitudinal axis, and a plurality of antenna element bays located equidistantly along the support mast. Each of the antenna element bays comprises a stripline driving circuit board positioned orthogonal to the longitudinal axis of the support mast, and a set of radiating elements symmetrically positioned around the support mast and electrically connected to the driving circuit board. A suspended-line circuit extends through the support mast and is electrically connected to the driving circuit board in each of the antenna element bays to provide a driving feed signal to each of the radiating elements.

20 Claims, 10 Drawing Sheets

(56) References Cited

U.S. PATENT DOCUMENTS

| | | | | | |
|---|---|---|---|---|---|
| 3,329,959 | A * | 7/1967 | Laub et al. | H01Q 21/26 | 343/796 |
| 3,413,644 | A * | 11/1968 | Laub et al. | H01Q 21/26 | 343/800 |
| 3,604,010 | A | 9/1971 | Schwartz et al. | | |
| 4,021,813 | A * | 5/1977 | Black | H01Q 3/242 | 342/374 |
| 4,083,051 | A | 4/1978 | Woodward | | |
| 4,090,203 | A | 5/1978 | Duncan | | |
| 4,262,265 | A | 4/1981 | Nygren et al. | | |
| 4,383,226 | A | 5/1983 | Nygren et al. | | |
| 4,590,480 | A | 5/1986 | Nikilayuk et al. | | |
| 4,614,947 | A | 9/1986 | Rammos | | |
| 4,973,972 | A | 11/1990 | Huang | | |
| 4,980,692 | A | 12/1990 | Rudish et al. | | |
| 5,021,797 | A | 6/1991 | Dienes | | |
| 5,061,943 | A | 10/1991 | Rammos | | |
| 5,471,181 | A | 11/1995 | Park | | |
| 5,534,882 | A | 7/1996 | Lopez | | |
| 5,789,996 | A | 8/1998 | Borodulin | | |
| 5,861,858 | A * | 1/1999 | Niekamp | H01Q 1/1242 | 343/800 |
| 5,999,145 | A * | 12/1999 | Niekamp | H01Q 1/1242 | 343/800 |
| 6,043,722 | A | 3/2000 | Vaninetti et al. | | |
| 6,201,510 | B1 * | 3/2001 | Lopez | H01Q 9/16 | 343/797 |
| 6,249,261 | B1 * | 6/2001 | Solberg, Jr. | G01S 3/04 | 343/801 |
| 6,366,185 | B1 | 4/2002 | Keesey et al. | | |
| 6,384,788 | B2 | 5/2002 | Pretorius et al. | | |
| 6,437,740 | B1 | 8/2002 | De Champlain et al. | | |
| 6,452,562 | B1 | 9/2002 | Nyhus | | |
| 6,480,167 | B2 | 11/2002 | Matthews | | |
| 6,608,601 | B1 | 8/2003 | Collinson et al. | | |
| 6,621,469 | B2 | 9/2003 | Judd et al. | | |
| 6,640,085 | B1 | 10/2003 | Chatzipetros et al. | | |
| 6,697,029 | B2 | 2/2004 | Teillet et al. | | |
| 6,717,555 | B2 | 4/2004 | Teillet et al. | | |
| 6,727,777 | B2 | 4/2004 | McDonough et al. | | |
| 6,885,343 | B2 | 4/2005 | Roper | | |
| 7,075,497 | B2 | 7/2006 | Teillet et al. | | |
| 7,119,757 | B1 * | 10/2006 | Lopez | H01Q 21/08 | 343/800 |
| 7,417,597 | B1 | 8/2008 | Lopez | | |
| 7,839,235 | B2 | 11/2010 | Xiong et al. | | |
| 8,049,667 | B2 * | 11/2011 | Lackey | G01S 19/21 | 342/368 |
| 8,154,466 | B2 | 4/2012 | Lewis et al. | | |
| 8,164,532 | B1 | 4/2012 | Brown et al. | | |
| 8,217,839 | B1 | 7/2012 | Paulsen | | |
| 2002/0158808 | A1 | 10/2002 | Inoue | | |
| 2004/0048420 | A1 | 3/2004 | Miller | | |
| 2004/0056819 | A1 | 3/2004 | McCarthy et al. | | |
| 2005/0088337 | A1 | 4/2005 | Lorenz | | |
| 2005/0110699 | A1 | 5/2005 | Timofeev et al. | | |
| 2005/0168301 | A1 | 8/2005 | Carson | | |
| 2007/0046393 | A1 | 3/2007 | Quan et al. | | |
| 2007/0285334 | A1 | 12/2007 | Tsutsumi et al. | | |
| 2009/0278761 | A1 | 11/2009 | Makinen et al. | | |
| 2010/0141530 | A1 | 6/2010 | McMahon | | |
| 2012/0038530 | A1 | 2/2012 | Chen et al. | | |
| 2013/0057449 | A1 | 3/2013 | Orihashi et al. | | |
| 2013/0059533 | A1 | 3/2013 | Kwon et al. | | |
| 2013/0070819 | A1 | 3/2013 | Zhao et al. | | |
| 2013/0342280 | A1 | 12/2013 | Blanton et al. | | |
| 2015/0200465 | A1 | 7/2015 | Wang et al. | | |
| 2015/0201494 | A1 | 7/2015 | Wang et al. | | |
| 2015/0311598 | A1 | 10/2015 | Wang et al. | | |
| 2015/0333411 | A1 | 11/2015 | Wang et al. | | |

FOREIGN PATENT DOCUMENTS

| | | |
|---|---|---|
| CN | 103152015 | 6/2013 |
| DE | 102004063784 | 7/2006 |
| DE | 102005063234 | 6/2007 |
| EP | 0512487 | 5/1992 |
| EP | 2254197 | 11/2010 |
| EP | 2434577 | 3/2012 |
| WO | 2007069809 | 6/2007 |

OTHER PUBLICATIONS

U.S. Patent and Trademark Office, "Office Action", from U.S. Appl. No. 14/156,576, Feb. 1, 2016, pp. 1-28, Published in: US.

State Intellectual Property Office, the P.R. China, "International Search Report and Written Opinion", from PCT Counterpart of U.S. Appl. No. 13/879,300, Nov. 21, 2013, pp. 1-11.

European Patent Office, "Extended European Search Report from EP Application No. 15150863.7 mailed May 19, 2015", from Foreign Counterpart of U.S. Appl. No. 14/156,576, May 19, 2015, pp. 1-7, Published in: EP.

European Patent Office, "Extended European Search Report from EP Application No. 15150390.1 mailed May 21, 2015", from Foreign Counterpart of U.S. Appl. No. 14/154,886, May 21, 2015, pp. 1-6, Published in: EP.

Varlamos et al., "Electronic Beam Steering Using Switched Parasitic Smart Antenna Arrays", Progress in Electromagnetics Research, PIER 36, 2002, pp. 101-119, Publisher: National Technical Institute of Athens.

European Patent Office, "Extended European Search Report from EP Application No. 15150542.7 mailed Jun. 11, 2015", from Foreign Counterpart of U.S. Appl. No. 14/155,920, Jun. 11, 2015, pp. 1-11, Published in: EP.

Inclan-Alonso et al., "Low Loss Power Distribution Network in Stripline Technology for Planar Array Antennas", Progress in Electromagnets Research, Nov. 13, 2013, pp. 369-384, vol. 143.

The International Bureau of WIPO, "International Preliminary Report on Patentability from PCT Application No. PCT/CN2013/072065 mailed Sep. 11, 2015", from PCT Counterpart of U.S. Appl. No. 13/978,150, Sep. 11, 2015, pp. 1-7, Published in: WO.

U.S. Patent & Trademark Office, "Office Action", from U.S. Appl. No. 14/155,920, Oct. 7, 2015, Published in: US.

Wang et al., "Integrated Stripline Feed Network for Linear Antenna Array", "From U.S. Appl. No. 13/879,300", Apr. 12, 2013, pp. 1-18, Published in: US.

Wang et al., "Expanding Axial Ration Bandwidth for Very Low Elevations", "U.S. Appl. No. 13/978,150", Jul. 3, 2013, pp. 1-25, Published in: US.

Lopez, "LAAS/GBAS Ground Reference Antenna with Enhanced Mitigation of Ground Multipath", "The Institute of Navigation National Technical Meeting", Jan. 28, 2008, pp. 1-17, Publisher: BAE Systems.

Lopez, "GPS Landing System Reference Antenna", "IEEE Antennas and Propagation Magazine", Feb. 2010, pp. 104-113, vol. 52, No. 1, Publisher: IEEE.

United States Patent and Trademark Office, "Advisory Action", from U.S. Appl. No. 13/879,300, Nov. 17, 2016, pp. 1-5, Published in: US.

United States Patent and Trademark Office, "Office Action", from U.S. Appl. No. 13/978,150, Dec. 27, 2016, pp. 1-28, Published in: US.

European Patent Office, "European Search Report for EP Application No. 13874608.6", from Foreign counterpart of U.S. Appl. No. 14/154,886, Nov. 7, 2016, pp. 1-8, Published in: EP.

European Patent Office, "Office Action from EP Application No. 15150542.7 mailed May 23, 2016", from Foreign Counterpart of U.S. Appl. No. 14/155,920, May 23, 2016, pp. 1-8, Published in: EP.

U.S. Patent and Trademark Office, "Notice of Allowance", U.S. Appl. No. 14/155,920, Mar. 31, 2016, pp. 1-8.

* cited by examiner

BROADBAND GNSS REFERENCE ANTENNA

BACKGROUND

Differential Global Positioning System (D-GPS) systems enhance the capability of GPS receivers to provide much-improved accuracy from meters to centimeters. A ground-based reference station is involved in a D-GPS system to broadcast the pseudorange difference between the location indicated by GPS satellite signal processing and the known fixed location of the reference station. A GPS receiver may then use the broadcast data to correct its pseudorange by the same amount.

The positioning accuracy of a GPS system is affected by various factors. One such factor is that the receive antenna should, ideally, receive only the direct path GPS signal and filter out all undesired signals, most of which are contributed by ground reflected interference.

A D-GPS system generally requires better suppression of back/side lobes of both right hand circular polarization (RHCP) and left hand circular polarization (LHCP) gain patterns. In order to address this issue, reference antennas have been developed in which radiated antenna elements are sparsely-arranged. In one approach, non-fed antenna elements, which are not connected to a feed circuit, are inserted between two active elements, which are connected to the feed circuit, to improve the antenna performance. In another approach, a factor is used to adjust the spacing between radiated antenna elements to further improve antenna performance.

SUMMARY

A linear antenna array comprises a hollow support mast having a longitudinal axis, and a plurality of antenna element bays located equidistantly along the support mast. Each of the antenna element bays comprises a stripline driving circuit board positioned orthogonal to the longitudinal axis of the support mast, and a set of radiating elements symmetrically positioned around the support mast and electrically connected to the driving circuit board. A suspended-line circuit extends through the support mast and is electrically connected to the driving circuit board in each of the antenna element bays to provide a driving feed signal to each of the radiating elements.

BRIEF DESCRIPTION OF THE DRAWINGS

Features of the present invention will become apparent to those skilled in the art from the following description with reference to the drawings. Understanding that the drawings depict only typical embodiments and are not therefore to be considered limiting in scope, the invention will be described with additional specificity and detail through the use of the accompanying drawings, in which.

DETAILED DESCRIPTION

In the following detailed description, embodiments are described in sufficient detail to enable those skilled in the art to practice the invention. It is to be understood that other embodiments may be utilized without departing from the scope of the invention. The following detailed description is, therefore, not to be taken in a limiting sense.

A broadband Global Navigation Satellite System (GNSS) reference antenna is provided that includes a linear antenna array. The present GNSS reference antenna is particularly suitable for use in a Differential GPS (D-GPS) system as a high performance reference antenna in a ground-based reference station.

The GNSS reference antenna provides a wide bandwidth, sharp-cut off in the antenna radiation pattern, and enhanced side/back lobes suppression. The present reference antenna can be fabricated and assembled with standard manufacturing techniques.

Figure 1:
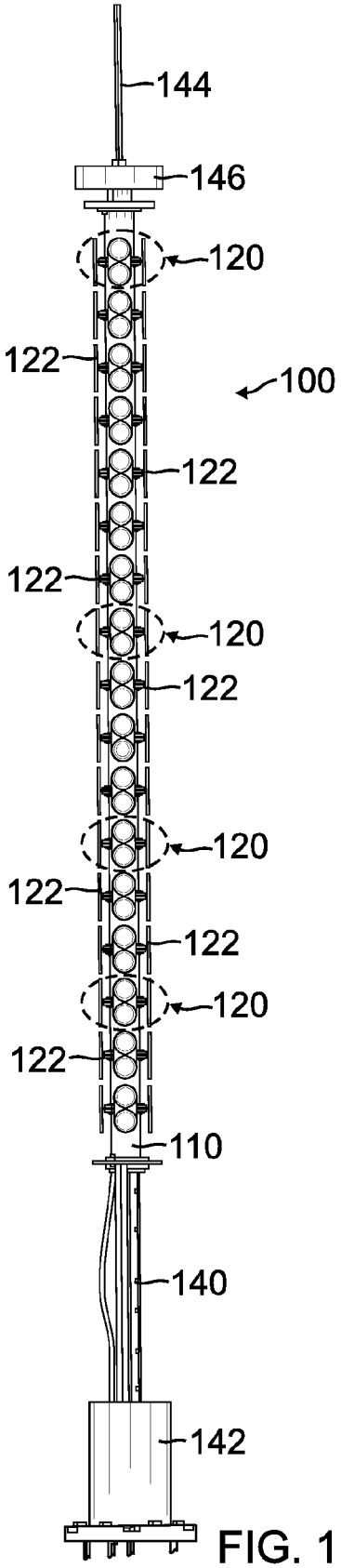
FIG. 1 is a side view of a linear antenna array according to one embodiment.
Figure 2:
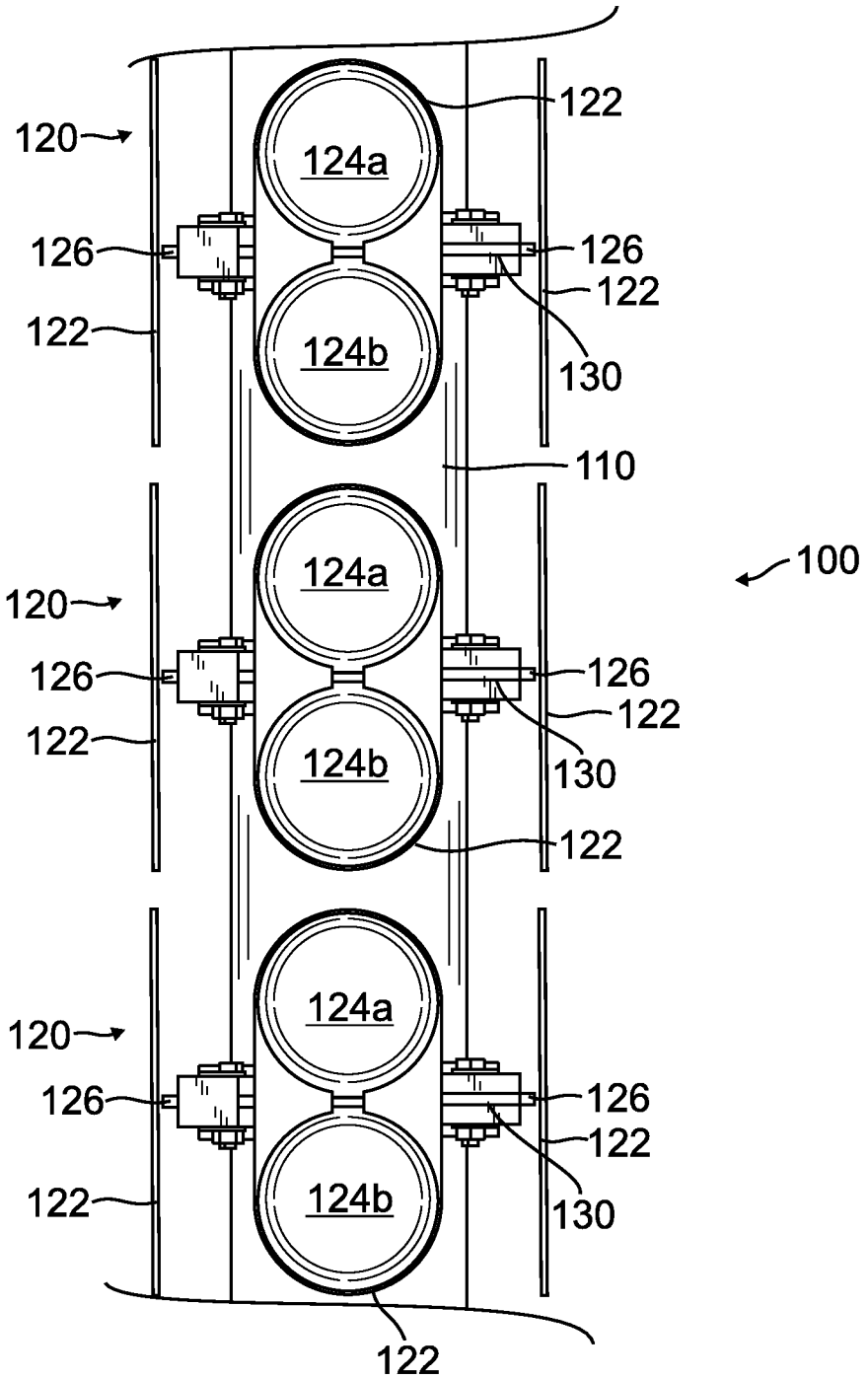
FIG. 2 is an enlarged side view of a portion of the linear antenna array of FIG. 1, showing a plurality of antenna element bays.
Figure 3:
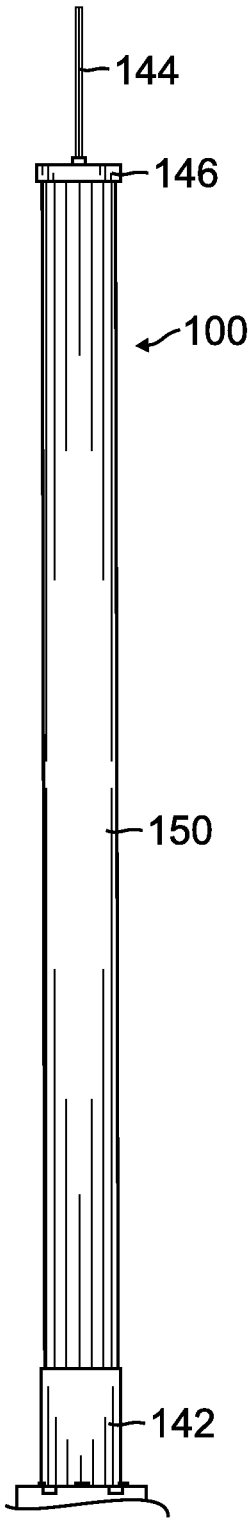
FIG. 3 is a side view of the linear antenna array of FIG. 1 with a housing structure thereon.

FIGS. 1-3 illustrate a linear antenna array 100 according to one embodiment, which can be employed as a high performance GNSS reference antenna such as in a D-GPS system. The linear antenna array 100 includes a hollow support mast 110 having a longitudinal axis along the length thereof. A plurality of antenna element bays 120 are each located equidistantly along the length of support mast 110. For example, each element bay can be spaced from a neighboring element bay at a distance of about $\lambda/2$, where $\lambda$, represents the incoming signal wavelength. Each of element bays 120 also include a set of radiating elements 122 symmetrically positioned around support mast 110. The radiating elements 122 can have an elongated oval shape.

As shown in FIG. 2, each of element bays 120 comprise a driving circuit board 130 positioned orthogonal to the longitudinal axis of support mast 110. The radiating elements 122 of each element bay 120 are electrically connected to the respective driving circuit board 130. The driving circuit board 130 can be multilayered printed circuit board (PCB), which provides an integrated feed network for radiating elements 122.

The radiating elements 122 each include a pair of broadband radiator discs 124*a* and 124*b* that are aligned with the longitudinal axis of support mast 110 and driven by a respective stripline driving circuit board 130 in each of element bays 120. The radiating elements 122 can be vertically mounted onto a corresponding edge of a driving circuit board 130 in each of element bays 120 such that radiating elements 122 are perpendicular to a plane defined by driving circuit board 130. In this configuration, radiator disc 124*a* of each radiating element 122 is located above the plane defined by driving circuit board 130, and radiator disc 124*b* of each radiating element 122 is located below the plane defined by driving circuit board 130.

In one embodiment, a tab 126 connects a central portion of each radiating element 122 to driving circuit board 130 in each element bay 120. The tabs 126 provide both an electrical and mechanical connection between radiating elements 122 and driving circuit board 130.

Each pair of radiator discs 124*a*, 124*b* on a radiating element 122 can be fabricated by forming the discs on a PCB by conventional techniques. For example, a PCB with a copper layer can be etched such that the copper layer is formed into the circular shapes of the radiator discs, which can then be plated with gold. The radiating elements with the radiator disc pairs can then be produced by cutting the gold-plated PCB into multiple elongated oval shapes. The circular design of the radiator disc pairs allows linear antenna array 100 to be utilized in ultra-wide band (UWB) applications.

In one embodiment, each of element bays 120 includes four radiating elements 122 mounted equidistantly around support mast 110. This results in each of element bays 120 having four pairs of radiator discs 124*a*, 124*b* for a total of eight radiator discs. In this configuration, each radiating element 122 is located directly opposite from another one of the radiating elements, and is positioned at an angle of about 90 degrees with respect to adjacent radiating elements.

As depicted in FIG. 1, a suspended-line circuit 140 extends from a base section 142 through support mast 110. The suspended-line circuit 140 is electrically connected to each of the driving circuit boards in element bays 120 to provide a driving feed signal to each of radiating elements 122. This configuration allows each of element bays 120 to be actively fed without the presence of intervening parasitic elements separating any two of the element bays.

A lighting rod 144 protrudes from a distal end of suspended-line circuit 140 and extends above a cap 146 on support mast 110. The lightning rod can be assembled directly onto a metallic bar structure of suspended-line circuit 140 that also provides a microwave ground.

The linear antenna array 100 can be mounted vertically in an upright position using base section 142. This allows support mast 110 to be oriented substantially normal to the horizon. The orientation of radiating elements 122 provides a linear array pattern covering the upper hemisphere with a sharp cut-off signal pattern at a relatively small angle above the horizon.

As illustrated in FIG. 3, a tubular housing structure 150 can be employed to protect antenna array 100 from outside environmental conditions. The tubular housing structure 150 surrounds the antenna element bays and is coupled between cap 146 and base section 142. The tubular housing structure 150 is composed of a material that is transparent to radio frequency (RF) signals, such as a plastic material.

Figure 4:
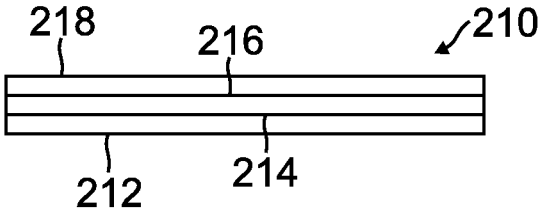
FIG. 4 is a side view of a stack structure for a driving circuit that can be implemented in the linear antenna array of FIG. 1.

In one embodiment, the driving circuit board 130 in each element bay 120 provides a progressive-phase-omnidirectional (PPO) driving network for the driving circuit of the radiator discs in each of radiating elements 122. This driving circuit can be implemented in a PCB stack structure 210 as shown in FIG. 4. The stack structure 210 includes a bottom layer 212, a first ground layer 214 over bottom layer 212, a second ground layer 216 over ground layer 214, and a top layer 218 over ground layer 216.

Figure 5:
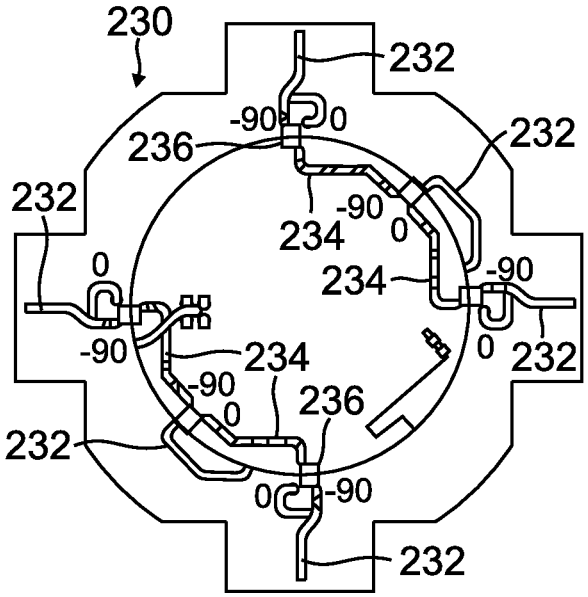
FIG. 5 is a top view of a driving circuit layout for the stack structure of FIG. 4.
Figure 6:
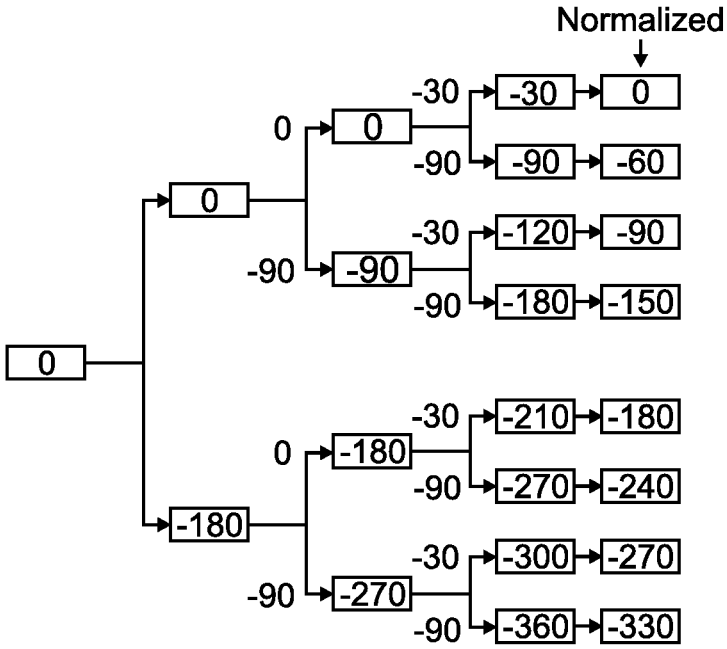
FIG. 6 is a diagram of exemplary driving parameters for radiating elements of the linear antenna array of FIG. 1.

FIG. 5 is a top view of a stripline driving circuit layout 230 for stack structure 210. The circuit layout for top layer 218 is shown with solid lines 232, and the circuit layout for bottom layer 212 is shown with dashed lines 234. A RF signal can be transferred through a common port on top layer 218 by an RF connector that provides a signal input/output interface. A total of six two-way power dividers 236 with 90°/0° phase-difference between two output ports are assembled on bottom layer 212. Exemplary driving parameters for each of the radiator discs in the radiating elements are shown in the diagram of FIG. 6, in which the normalized phase for each respective disc in degrees is 0, −60, −90, −150, −180, −240, −270, and −330.

Figure 7:
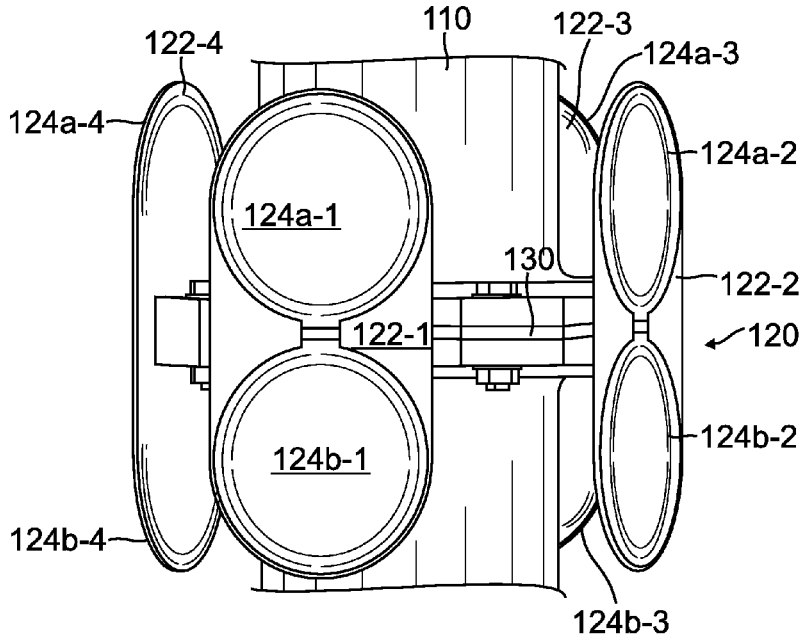
FIG. 7 is an enlarged side view of a portion of the linear antenna array of FIG. 1, showing a single antenna element bay.
Figure 8A:
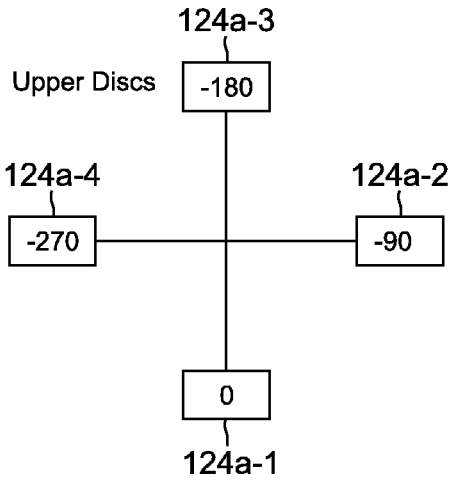
FIGS. 8A and 8B are schematic diagrams of an exemplary driving topology for the antenna element bay of FIG. 7.
Figure 8B:
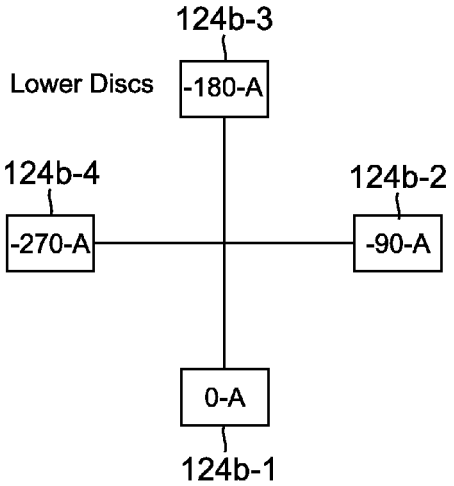

An exemplary driving topology for an antenna element bay of the linear antenna array of FIG. 1 is illustrated in FIGS. 7 and 8A-8B. FIG. 7 shows an antenna element bay 120, which includes four radiating elements 122-1, 122-2, 122-3, and 122-4 mounted equidistantly around support mast 110. The four radiating elements each include a pair of broadband radiator discs 124*a*-1, 124*b*-1; 124*a*-2, 124*b*-2; 124*a*-3, 124*b*-3; and 124*a*-4, 124*b*-4. The radiator discs 124*a*-1 to 124*a*-4 are located above the plane defined by driving circuit board 130, and thus correspond to the upper discs in FIG. 8A. The radiator discs 124*b*-1 to 124*b*-4 are located below the plane defined by driving circuit board 130, and thus correspond to the lower discs in FIG. 8B.

As shown in FIG. 8A, upper disc 124*a*-1 has a phase of 0°, upper disc 124*a*-2 has a phase of −90°, upper disc 124*a*-3 has a phase of −180°, and upper disc 124*a*-4 has a phase of −270°. Correspondingly, as shown in FIG. 8B, lower disc 124*b*-1 has a phase of −A, lower disc 124*b*-2 has a phase of −90°−A, lower disc 124*b*-3 has a phase of −180°−A, and lower disc 124*b*-4 has a phase of −270°−A, where A can be 60° for example. In this example, lower disc 124*b*-1 has a phase of −60°, lower disc 124*b*-2 has a phase of −150°, lower disc 124*b*-3 has a phase of −240°, and lower disc 124*b*-4 has a phase of −330°.

The expected driving amplitudes and phases for an exemplary linear antenna array with 17 element bays, such as shown in FIG. 1, are listed in Table 1.

TABLE 1

| BAYS | Feed Phase (Step 1) | Rotate (Step 2) | Equivalent Phase | Amplitude (dB) |
|---|---|---|---|---|
| 1 (top) | 180 | 0 | 180 | −32.4 |
| 2 | 90 | −180 | −90 | −24.16 |
| 3 | 180 | −180 | 0 | −38.82 |
| 4 | 90 | −180 | −90 | −20.48 |
| 5 | 90 | −90 | 0 | −34.6 |
| 6 | 90 | −180 | −90 | −14.68 |
| 7 | 90 | −90 | 0 | −30.71 |
| 8 | 0 | −90 | −90 | −4.39 |
| 9 | 0 | 0 | 0 | 0 |
| 10 | 0 | −270 | 90 | −4.22 |
| 11 | 90 | −90 | 0 | −30.32 |
| 12 | 90 | 0 | 90 | −14.22 |
| 13 | 90 | −90 | 0 | −34 |
| 14 | 90 | 0 | 90 | −20.05 |
| 15 | 180 | −180 | 0 | −35.17 |
| 16 | 90 | 0 | 90 | −23.58 |
| 17 (Bottom) | 180 | 0 | 180 | −35 |

Figure 9:
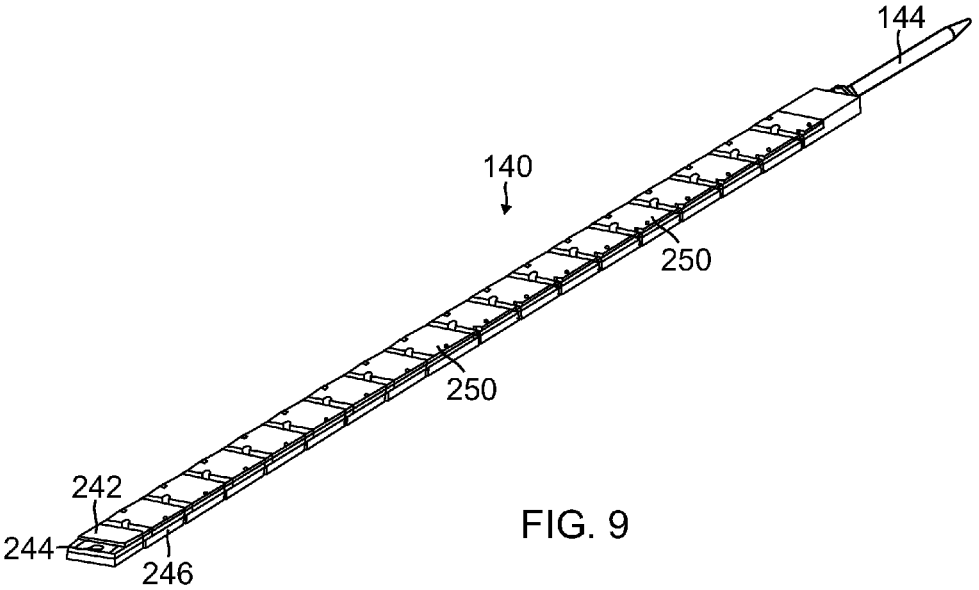
FIG. 9 is a perspective view of a suspended-line circuit, which can be employed in the linear antenna array of FIG. 1.

FIG. 9 illustrates further details of suspended-line circuit 140, which can be used as feeding structure to implement the antenna configuration set forth in Table 1. The suspended-line circuit 140 includes a pair of elongated circuit boards 242 and 244 with an air dielectric that extend along the length of suspended-line circuit 140 in a stacked configuration. A conductive layer 246 under circuit board 244 provides a microwave ground and a lightning ground. In this embodiment, lighting rod 144 can be coupled to conductive layer 246 and protrudes from a distal end of suspended-line circuit 140. Additionally, a plurality of RF connectors can be coupled to respective nodes 250 along suspended-line circuit 140 for each element bay.

Figure 10A:
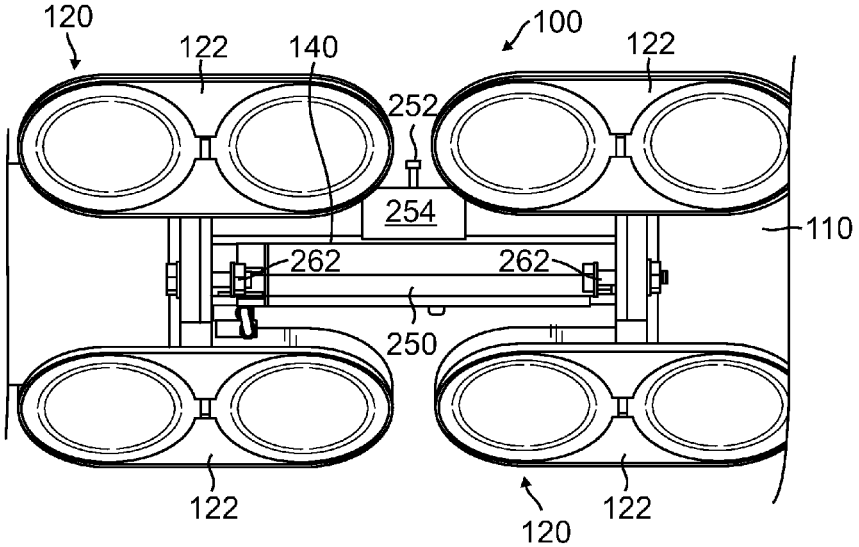
FIG. 10A is a side view of a portion of the linear antenna array of FIG. 1.
Figure 10B:
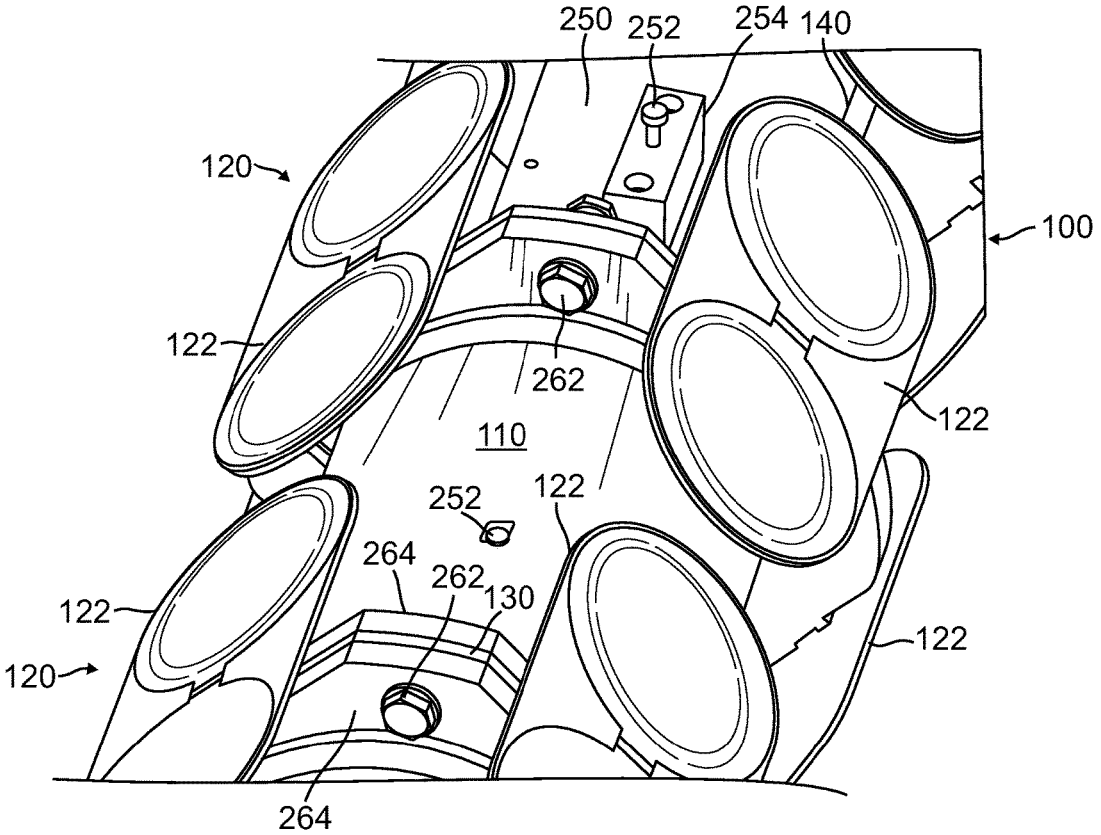
FIG. 10B is a perspective of a portion of the linear antenna array of FIG. 1.

FIGS. 10A and 10B illustrate further details of the assembly of linear antenna array 100. As shown in FIGS. 10A and 10B, a mast section of support mast 110 is removed to reveal a node 250 of suspended-line circuit 140 extending through support mast 110. At least one screw 252 can used to connect respective mast sections of support mast 110 to suspended-line circuit 140 through a spacer structure 254 between the mast section and a surface of node 250 to enhance the mechanical strength of the antenna array.

In addition, during assembly of linear antenna array 100, each element bay 120 can be rotated at 90° steps to adjust the equivalent driving phase. This changes the angular position of radiating elements 122. After the appropriate rotation of element bays 120, the angular position of radiating elements 122 in each element bay can be secured with one or more bolts 262, which couple driving circuit board 130 between support plates 264 on mast 110, as shown in FIG. 10B.

Figure 11A:
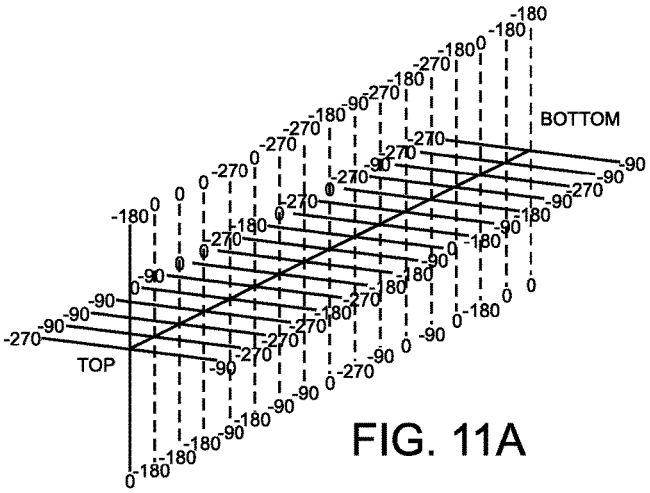
FIG. 11A is a schematic diagram showing the phases of each of four radiating elements in an exemplary linear antenna array with multiple element bays.
Figure 11B:
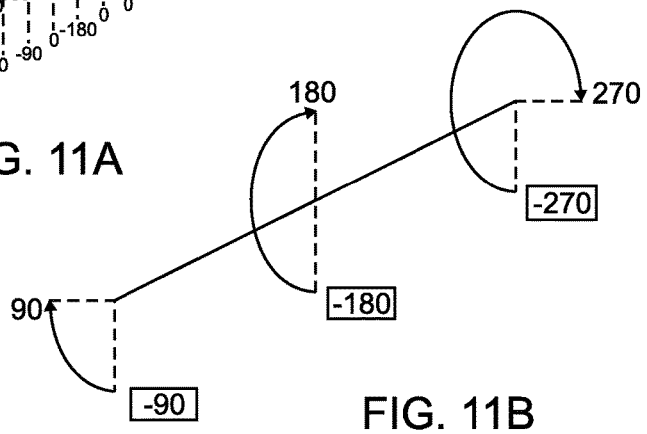
FIG. 11B is a schematic diagram depicting that the element bays of an exemplary linear antenna array can be rotated at 90° increments.

FIG. 11A is a schematic diagram showing the phases of each of the four radiating elements in an exemplary linear antenna array with 17 element bays, from the top bay to the bottom bay. FIG. 11B is a schematic diagram depicting that each bay can be rotated at 90° increments to adjust the equivalent driving phase.

Figure 12:
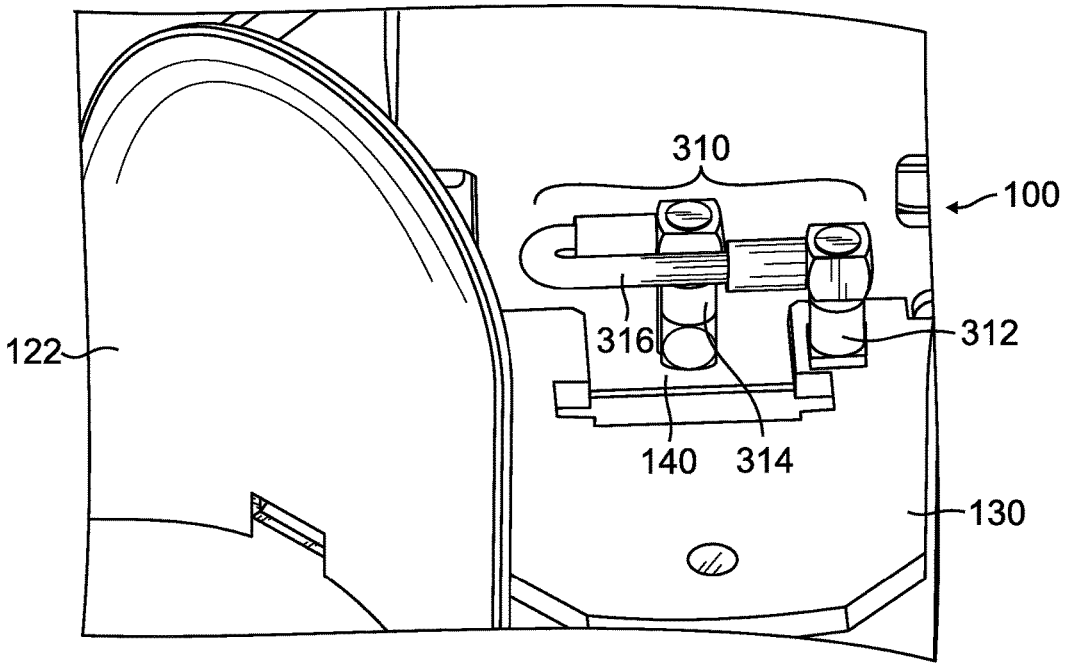
FIG. 12 illustrates the connections between driving components for the linear antenna array of FIG. 1.

FIG. 12 illustrates the connections between driving components for linear antenna array 100. An RF cable set 310 is employed in each element bay and includes a pair of RF connectors 312 and 314. The RF connector 312 is coupled to driving circuit board 130, and RF connector 314 is coupled to suspended-line circuit 140. A short RF cable 316 is coupled between RF connectors 312 and 314 to provide signal communication between the driving components.

The present linear antenna array can cover a wide bandwidth during operation. For example, the linear antenna array can be configured to cover from about 1.15 GHz to about 1.58 GHz.

Figure 13:
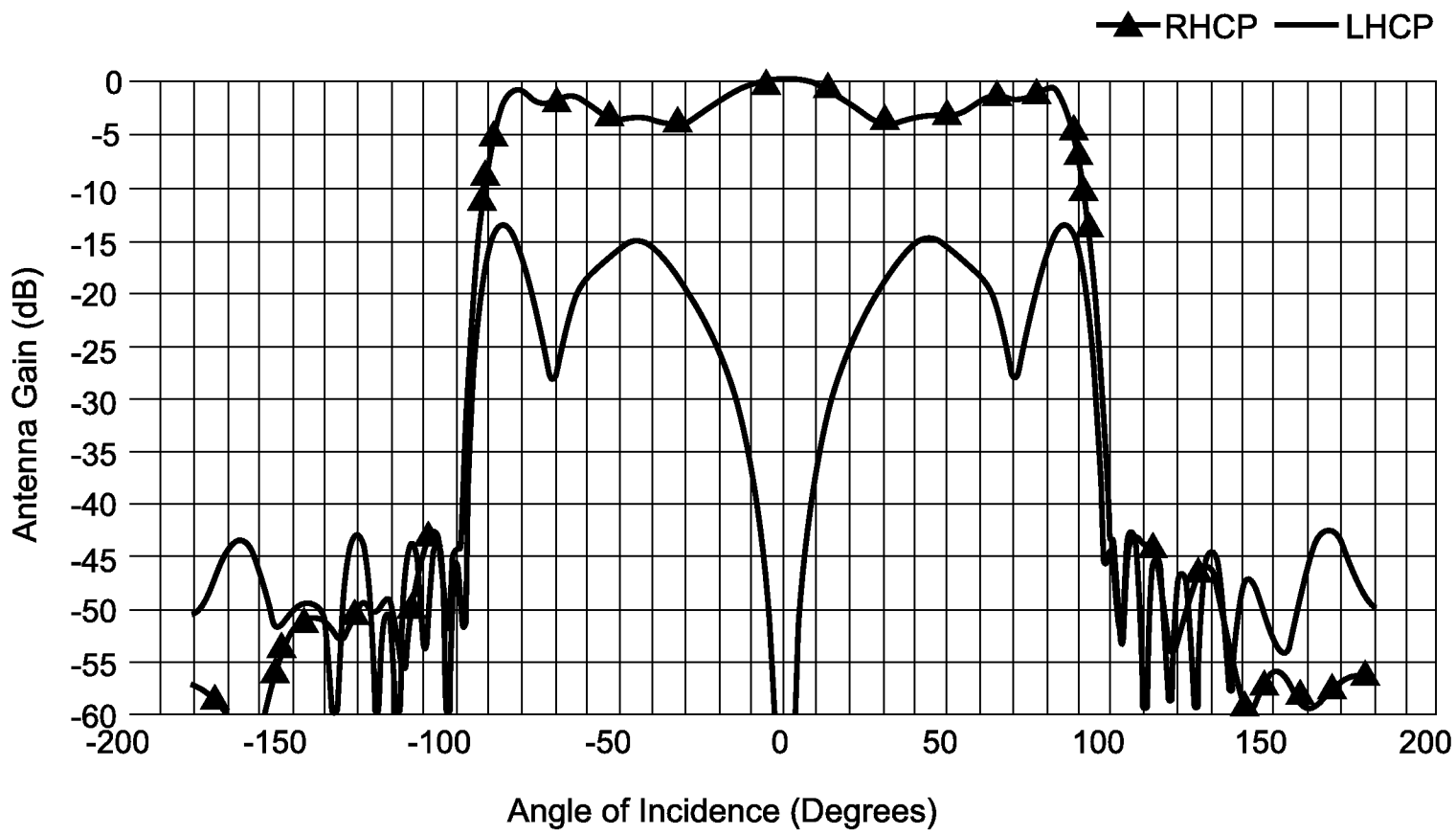
FIGS. 13 and 14 are graphs showing the signal gain patterns at two different frequencies for an exemplary linear antenna array.
Figure 14:
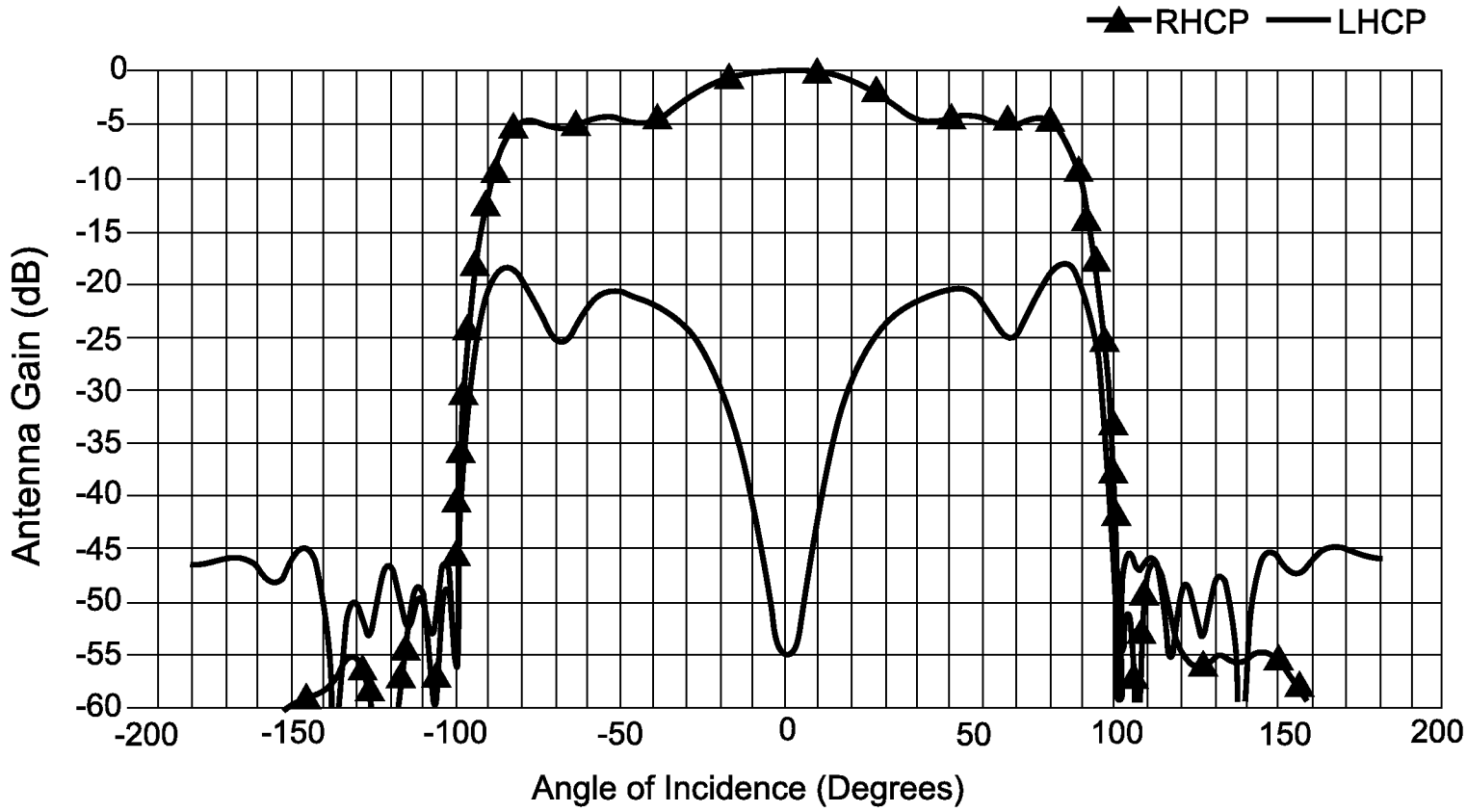

The graph of FIG. 13 shows the signal gain patterns with respect to angle of incidence at a GPS frequency of 1.575 GHz for a linear antenna array with 17 bays. Both the right hand circular polarization (RHCP) gain pattern and the left hand circular polarization (LHCP) gain pattern are shown. The graph of FIG. 14 shows the signal gain patterns at a GPS frequency of 1.22 GHz for a linear antenna array with 17 bays. Again, both the RHCP gain pattern and the LHCP gain pattern are shown.

As indicated in the graphs of FIGS. 13 and 14, the antenna response to reflections from the ground below the horizon (outside of the range between 90 and −90 degrees) is substantially minimized. In addition, the antenna response to reflections that come from above the horizon as an LHCP signal is substantially reduced, particularly when coming from straight above the antenna (0 degrees).

Example Embodiments

Example 1 includes a linear antenna array comprising a hollow support mast having a longitudinal axis, and a plurality of antenna element bays located equidistantly along the support mast. Each of the antenna element bays comprises a stripline driving circuit board positioned orthogonal to the longitudinal axis of the support mast, and a set of radiating elements symmetrically positioned around the support mast and electrically connected to the driving circuit board. A suspended-line circuit extends through the support mast and is electrically connected to the driving circuit board in each of the antenna element bays to provide a driving feed signal to each of the radiating elements.

Example 2 includes the linear antenna array of Example 1, wherein each of the antenna element bays are spaced from a neighboring antenna element bay at a distance of about $\lambda/2$, where $\lambda$ represents the incoming signal wavelength.

Example 3 includes the linear antenna array of any of Examples 1-2, wherein each of the radiating elements include a pair of broadband radiator discs aligned with the longitudinal axis of the support mast.

Example 4 includes the linear antenna array of any of Examples 1-3, wherein each of the antenna element bays includes four radiating elements.

Example 5 includes the linear antenna array of Example 4, wherein each of the four radiating elements is positioned directly opposite from another one of the radiating elements and located at an angle of about 90 degrees with respect to adjacent radiating elements.

Example 6 includes the linear antenna array of any of Examples 1-5, wherein the radiating elements have an elongated oval shape.

Example 7 includes the linear antenna array of any of Examples 1-6, wherein the driving circuit board comprises a multilayered printed circuit board that provides an integrated feed network for the radiating elements.

Example 8 includes the linear antenna array of Example 7, wherein the integrated feed network comprises a progressive-phase-omnidirectional driving network.

Example 9 includes the linear antenna array of any of Examples 1-8, wherein a central portion of the radiating elements is vertically mounted onto a corresponding edge of the driving circuit board in each of the element bays such that the radiating elements are perpendicular to a plane defined by the driving circuit board.

Example 10 includes the linear antenna array of Example 9, wherein one disc of the radiator disc pairs of each radiating element is located above the plane defined by the driving circuit board, and the other disc of the radiator disc pairs is located below the plane defined by the driving circuit board.

Example 11 includes the linear antenna array of any of Examples 1-10, further comprising a lighting rod that protrudes above the support mast and is coupled to a distal end of the suspended-line circuit.

Example 12 includes the linear antenna array of any of Examples 1-11, wherein the support mast is vertically mounted in an upright position.

Example 13 includes the linear antenna array of any of Examples 1-12, further comprising a tubular housing structure surrounding the antenna element bays and transparent to RF signals.

Example 14 includes the linear antenna array of any of Examples 1-13, wherein each of the element bays includes a first RF connector coupled to the driving circuit board and a second RF connector coupled to the suspended-line circuit.

Example 15 includes the linear antenna array of Example 14, wherein the first RF connector is electrically connected to the second RF connector with an RF cable.

Example 16 includes the linear antenna array of any of Examples 1-15, wherein the antenna array is configured as a GNSS reference antenna.

Example 17 includes the linear antenna array of any of Examples 1-16, wherein the antenna array is configured for a differential-GPS system.

Example 18 includes the linear antenna array of any of Examples 1-17, wherein the antenna array is configured to receive a frequency from about 1.15 GHz to about 1.58 GHz.

Example 19 includes a method of manufacturing a linear antenna array, the method comprising: providing a hollow support mast; providing a plurality of antenna element bays each comprising a stripline driving circuit board, and a set of radiating elements electrically connected to the driving circuit board; placing the plurality of antenna element bays equidistantly along the support mast; rotating one or more of the element bays in 90° increments around the support mast to adjust an equivalent driving phase for each of the radiating elements; and electrically connecting the driving circuit board in each of the element bays to a suspended-line circuit extending through the support mast to provide a driving feed signal to each of the radiating elements.

Example 20 includes the method of Example 19, wherein the antenna array is configured for a differential-GPS system, and configured to receive a frequency from about 1.15 GHz to about 1.58 GHz.

The present invention may be embodied in other specific forms without departing from its essential characteristics. The described embodiments are to be considered in all respects only as illustrative and not restrictive. The scope of the invention is therefore indicated by the appended claims rather than by the foregoing description. All changes that come within the meaning and range of equivalency of the claims are to be embraced within their scope.

What is claimed is:

1. A linear antenna array, comprising:

a hollow support mast having a longitudinal axis;

three or more antenna element bays coupled to the support mast, wherein all of the antenna element bays coupled to the support mast are equidistantly spaced from a neighboring antenna element bay along the support mast, each of the antenna element bays comprising:

a stripline driving circuit board positioned orthogonal to the longitudinal axis of the support mast; and a set of radiating elements symmetrically positioned around the support mast and electrically connected to the driving circuit board; and a suspended-line circuit extending through the support mast and electrically connected to the driving circuit board in each of the antenna element bays to provide a driving feed signal to each of the radiating elements;

wherein the antenna element bays are each rotatable in increments of about 90° around the support mast to adjust an equivalent driving phase for each of the radiating elements.

2. The linear antenna array of claim 1, wherein each of the antenna element bays are spaced from a neighboring antenna element bay at a distance of about $\lambda/2$, where $\lambda$, represents the incoming signal wavelength.

3. The linear antenna array of claim 1, wherein each of the radiating elements include a pair of broadband radiator discs aligned with the longitudinal axis of the support mast.

4. The linear antenna array of claim 3, wherein each of the antenna element bays includes four radiating elements.

5. The linear antenna array of claim 4, wherein each of the four radiating elements is positioned directly opposite from another one of the radiating elements and is located at an angle of about 90 degrees with respect to adjacent radiating elements.

6. The linear antenna array of claim 1, wherein the radiating elements have an elongated oval shape.

7. The linear antenna array of claim 1, wherein the driving circuit board comprises a multilayered printed circuit board that provides an integrated feed network for the radiating elements.

8. The linear antenna array of claim 7, wherein the integrated feed network comprises a progressive-phase-omnidirectional driving network.

9. The linear antenna array of claim 1, wherein a central portion of the radiating elements is vertically mounted onto a corresponding edge of the driving circuit board in each of the element bays such that the radiating elements are perpendicular to a plane defined by the driving circuit board.

10. The linear antenna array of claim 9, wherein one disc of the radiator disc pairs of each radiating element is located above the plane defined by the driving circuit board, and the other disc of the radiator disc pairs is located below the plane defined by the driving circuit board.

11. The linear antenna array of claim 1, further comprising a lighting rod that protrudes above the support mast and is coupled to a distal end of the suspended-line circuit.

12. The linear antenna array of claim 1, wherein the support mast is vertically mounted in an upright position.

13. The linear antenna array of claim 1, further comprising a tubular housing structure surrounding the antenna element bays and transparent to radio frequency (RF) signals.

14. The linear antenna array of claim 1, wherein each of the element bays includes a first RF connector coupled to the driving circuit board and a second RF connector coupled to the suspended-line circuit.

15. The linear antenna array of claim 14, wherein the first RF connector is electrically connected to the second RF connector with an RF cable.

16. The linear antenna array of claim 1, wherein the antenna array is configured as a GNSS reference antenna.

17. The linear antenna array of claim 1, wherein the antenna array is configured for a differential-GPS system.

18. The linear antenna array of claim 1, wherein the antenna array is configured to receive a frequency from about 1.15 GHz to about 1.58 GHz.

19. A method of manufacturing a linear antenna array, the method comprising:

providing a hollow support mast;

providing three or more antenna element bays each comprising a stripline driving circuit board, and a set of radiating elements electrically connected to the driving circuit board;

placing all of the antenna element bays equidistantly along the support mast such that each of the element bays is spaced from a neighboring element bay by a distance of about $\lambda/2$, where $\lambda$, represents an incoming signal wavelength;

rotating one or more of the element bays in increments of about 90° around the support mast to adjust an equivalent driving phase for each of the radiating elements; and electrically connecting the driving circuit board in each of the element bays to a suspended-line circuit extending through the support mast to provide a driving feed signal to each of the radiating elements.

20. The method of claim 19, wherein the antenna array is configured for a differential-GPS system, and configured to receive a frequency from about 1.15 GHz to about 1.58 GHz.

* * * * *